US005293537A

United States Patent [19]

Carrish

[11] Patent Number: 5,293,537

[45] Date of Patent: Mar. 8, 1994

[54] IMAGE TRANSPORT FUSING SYSTEM

[75] Inventor: Jeffrey J. Carrish, Milford, Mass.

[73] Assignee: Delphax Systems, Canton, Mass.

[21] Appl. No.: 983,101

[22] Filed: Nov. 13, 1992

Related U.S. Application Data

[63] Continuation of Ser. No. 639,925, Jan. 10, 1991, abandoned.

[51] Int. Cl.[5] ..... G03G 15/20

[52] U.S. Cl. ..... 355/285; 355/290

[58] Field of Search ..... 355/282, 284, 285, 289, 355/290, 295; 219/216

[56] References Cited

U.S. PATENT DOCUMENTS

| | | | |
|---|---|---|---|
| 3,578,797 | 5/1971 | Hodges et al. | 219/388 X |
| 3,811,828 | 5/1974 | Ohta | 432/227 |
| 3,937,572 | 2/1976 | Gaynor et al. | 96/1 R |
| 4,957,774 | 9/1990 | Doi et al. | 427/45.1 |
| 4,992,833 | 2/1991 | Derimiggio | 355/282 |
| 5,019,869 | 5/1991 | Patton | 355/290 |
| 5,055,884 | 10/1991 | Ndebi et al. | 355/282 |
| 5,070,373 | 12/1991 | Fukano et al. | 355/290 |
| 5,099,288 | 3/1992 | Britto et al. | 355/290 |
| 5,124,755 | 6/1992 | Hediger | 355/285 |
| 5,136,337 | 8/1992 | Baruch | 355/290 |

FOREIGN PATENT DOCUMENTS

| | | | |
|---|---|---|---|
| 0372479 | 12/1989 | European Pat. Off. . | |
| 0373678 | 12/1989 | European Pat. Off. . | |
| 0374738 | 12/1989 | European Pat. Off. . | |
| 0362791 | 4/1990 | European Pat. Off. . | |
| 0363686 | 4/1990 | European Pat. Off. . | |
| 0369378 | 5/1990 | European Pat. Off. . | |
| 0370519 | 5/1990 | European Pat. Off. . | |
| 0370520 | 5/1990 | European Pat. Off. . | |
| 0372558 | 6/1990 | European Pat. Off. . | |
| 0143324 | 12/1978 | Japan . | |
| 0147157 | 11/1981 | Japan | 355/290 |
| 0149072 | 8/1985 | Japan | 355/290 |
| 0158780 | 6/1990 | Japan | 355/290 |
| 0158782 | 6/1990 | Japan | 355/290 |
| 0221971 | 9/1990 | Japan | 355/290 |

*Primary Examiner*—Leo P. Picard
*Assistant Examiner*—Christopher Horgan
*Attorney, Agent, or Firm*—Lahive & Cockfield

[57] ABSTRACT

Fusing apparatus for an electrographic printer, includes an abhesive belt for carrying and contacting a recorded image, a low temperature heater to fuse the image, and an assembly for synchronously moving a sheet in contact with the belt past the heater for an extended dwell time so that the toned image attains a fusing temperature as it resides in thermal contact with the heater along an extended transport path. The belt has a release coating of low surface free energy. Image transfer or fusing may be accomplished at sufficiently low belt temperatures that a single belt may be employed to effect imaging, toning, image transfer and fusing steps without impairing heat-sensitive toning assemblies, photoconducting elements, or other temperature-sensitive parts of the printer.

20 Claims, 3 Drawing Sheets

IMAGE TRANSPORT FUSING SYSTEM

This application is a continuation of application Ser. No. 07/639,925, filed Jan. 10, 1991, now abandoned.

BACKGROUND OF THE INVENTION

The present invention relates to electrographic copying or printing systems, and more particularly to the fusing of toned images in such systems on a recording member. In such electrographic printing systems, a drum or belt is made to carry an electrostatic latent image, and the image is developed by a toner to form a visible image that is transferred to an ultimate recording member such as a paper or plastic sheet.

In a number of systems, the toner image is transferred to the sheet by means of a counter-electrode charged to provide electrostatic attraction; in others, it may be transferred by contact pressure. In either case, the transferred image remains relatively unconsolidated and loosely bound to the sheet, so that fusing is generally required to render the image stable and resistant to smearing.

For this purpose the image-bearing sheet is carried to another station within the printer at which heat, pressure or the like is applied to fuse the toned image, thus consolidating and adhering it permanently to the sheet. Such heat fusing may be effected by contacting the sheet to a heated platen or hot roll, or by passing it under a radiant heater or flash source of radiant energy. In some systems of this type, an intermediate transport member such as a separate belt is used to pick up the toned image from one dielectric imaging surface and transfer the toned image to a sheet which is brought into contact with the transfer member at the nip of a transfer roller. This transfer belt is heated, for example, by passing over a heated roller. In the latter case, the toned image is transferred and is simultaneously at least partially fused to the sheet as it passes the nip of the transfer roller. However, even in a hot-transfer construction, a post-fuser station is often desirable to achieve image permanence and suitable surface finish characteristics.

In systems involving electrostatic image formation with toning of the latent image, and transfer of the toned image to a sheet or ultimate recording member, the range of constructions is constrained, in that separate mechanisms are generally provided for image transfer and for image fusing, or in that when both events occur simultaneously, this is done by a heated transfer roller that contacts each portion of the image for a very brief time. In these systems the fusing station is generally maintained at a temperature substantially above the toner melting point, and significant amounts of heat energy may be lost from the fusing station to the transfer member. While such instantaneous-contact constructions maintain high sheet feed rates the high temperature fuser may limit the energy efficiency of the fusing step, and introduce further complexity when used with a variety of different toners.

It is therefore desirable to provide a printing process of higher thermal efficiency, or one that is carried out at lower temperatures, and which operates well with a variety of different toners.

SUMMARY OF THE INVENTION

In accordance with the present invention an electrographic print system creates a toned image on a recording sheet, and the toned image is fused as it lies in thermal contact with and travels synchronously with a belt having an abhesive surface that transports it over a low temperature heater. The fusing process has a long thermal time characteristic, and may be carried out at temperatures appreciably lower than conventional fusing systems, providing greater efficiency and less heat loss to the environment without sacrificing overall sheet transport rate.

A material having a low surface free energy constitutes the belt surface while the belt as a whole has an elasticity of compression which is sufficiently spongy to provide effective thermal contact with the recording sheet. The belt withstands temperatures of up to approximately 150° C. while maintaining its structural properties and integrity. The belt may be formed with a multi-layer construction that includes a thin but hard outer skin and an elastomeric sub-layer that is effective to provide conforming contact with the recording member. In some embodiments, the belt is preferably of low thermal mass, and heat is applied through the belt to the toned image.

In one embodiment, a pair of belts are synchronously driven and face each other along a heat fusion path, such that toned images on a sheet sandwiched between the two belts are fused on both sides. In another embodiment, a drum rotates synchronously and in contact with the belt about a substantial area of the drum surface, with the sheet immobilized between the belt and the drum as the image is fused.

In another embodiment, the belt may be the primary imaging member of a printer, having dielectric or photosensitive, and surface release Properties adapted to receive a latent image, tone the image, and transfer the toned image to a recording sheet. In this embodiment, the same belt property which allows transfer of the toner enables the belt to provide thermal contact to the toned image without picking up the melted toner.

BRIEF DESCRIPTION OF THE DRAWINGS

These and other features of the invention will be understood from a discussion of illustrative embodiments and figures, wherein.

DETAILED DESCRIPTION

Figure 1:
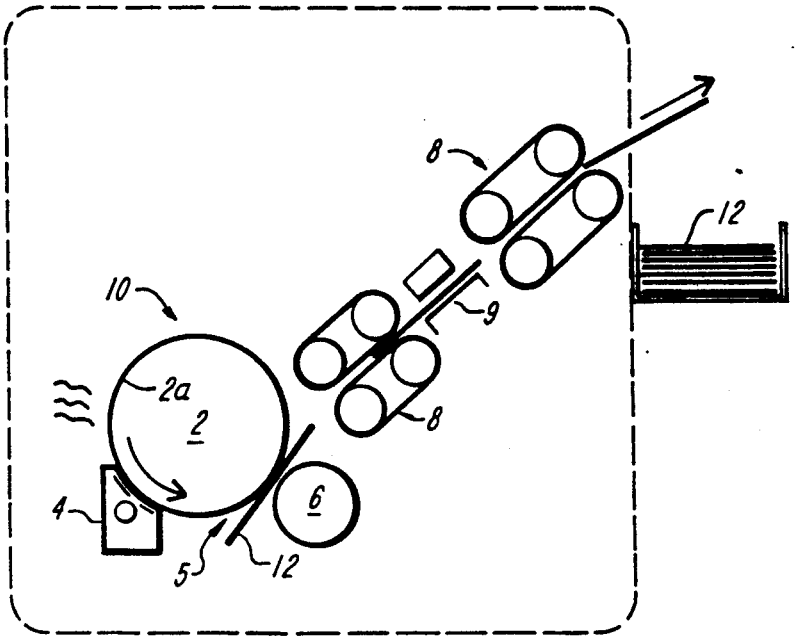
FIG. 1 (PRIOR ART)
FIG. 1 shows a representative printing apparatus of the prior art.

FIG. 1 illustrates in a schematic way the construction of a prior art printing apparatus 10, which forms a toned image, transfers the image to a sheet, and fuses the transferred image in separate and distinct processing steps, each involving one or more sub-assemblies having specialized electrical, mechanical or other physical properties. As illustrated in FIG. 1, system 10 comprises an imaging member 2 which receives a charge or latent image on its surface in a region 2*a*, and rotates past a toner applicator 4 which applies toner to develop the latent image. A pressure roller 6 creates a nip region 5 through which a recording sheet 12 is passed to receive the toned image from member 2. Once the sheet receives the image, a transport assembly 8 consisting of a plurality of belts and rollers operates to convey the recording sheet 12 over a hot Platen 9 to fuse or "fix" the toned image so that it more Permanently adheres to the sheet.

In such prior art constructions, numerous variations are possible. Hot platen 9 may be replaced by a radiantly heated region along the conveyor, or by a heated pressure roll or the like. Similarly, the illustrated initial imaging member may be replaced by a two-stage system, wherein an intermediate belt is used to receive a latent charge image or a visible toned image from a photosensitive drum and carry it to the transfer nip 5.

In these prior art constructions, the drum or initial imaging member has certain photoconductive or dielectric properties necessary for forming the latent image; the sheet 12 receives the toned image by electrostatic attraction, pressure transfer, or both, during a substantially instantaneous passage past roller 6; and the transferred image is fused at a separate region. While this architecture advantageously separates the heat fusion portion of the apparatus from the charging and image developing functions, it requires a fast heating cycle to bring the recorded sheet up to fusing temperature, without slowing the feed rate, and this, in turn, entails a high temperature, hence energetically inefficient, fusing station. The high temperatures cause short roller lifetimes. Recently it has been proposed to employ a high temperature ribbon heater rather than hot roll as a thermal contact fusing element, and to interpose a thin film between the heater and the toned surface. In such constructions, some improvement in efficiency is achieved by turning the heater element ON only when an image portion is passing it. However, elaborate control circuitry is required to assure that overheating does not occur during paper jams or other circumstances, and the construction may be limited to low speed operation.

Figure 2:
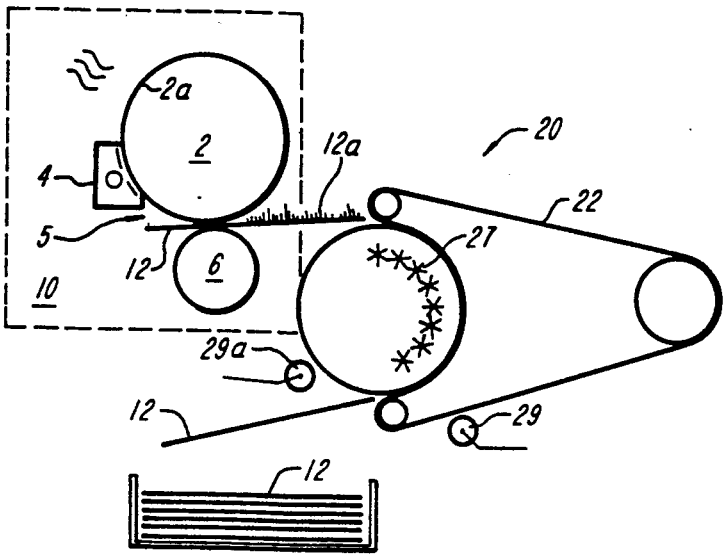
FIG. 2 shows a corresponding printing apparatus in accordance with the present invention.

As shown in FIG. 2, a system 20 according to one embodiment of the present invention effects fusing of a toned image on a sheet in a process wherein the toned sheet moves synchronously and in thermal contact with a belt through which it is heated to a fusing temperature. The image is thermally fused to the sheet over a relatively long time interval and at a temperature which is not substantially higher than the toner melt temperature. The heater is no more than seventy degrees, preferably ten to fifty degrees, and most preferably ten to thirty degrees Celsius above the toner melt temperature.

An imaging system 10 of conventional type forms an unfixed toned image **12*a* on a sheet 12, which passes to a belt 22 that forms one side of a sheet transport, and a roller 26 of relatively large diameter bears against belt 22 over a major fraction, e.g., a quarter to a half or more, of its circumference. A heat source, such as a radiant or contact heater unit 27 within the roller 26, maintains the belt/sheet transport region at a hot but relatively low temperature effective to fuse the toner. Belt 22 faces the toned image 12*a* on sheet 12**, and has a low surface free energy that does not allow the belt to pick up the toner once it has softened to a liquid or semi-liquid state.

With such surface, the gentle pressure of belt contact against roller 26 is effective to provide good thermal contact with the image and the sheet without picking up toner or distorting the image during transport or fusing. After fusing the toned image, belt 22 rotates past a cleaner roller 29 which has an absorbant or adhesive jacket that contacts the belt to pick up any residual toner, paper dust or the like adhered to the belt. This assures that the belt is clean and suitable for another cycle. However, as described further below the belt surface properties are such that a cleaner is not absolutely required, and when a cleaner is used, a simple blotter roller may suffice.

In an alternate embodiment, the sheet is fed into the fuser assembly with its toned side **12*a* facing the drum. In this case, the drum has a low surface free energy, and a cleaner roller 29*a*** is provided for the drum. The belt in this case serves only as a pressure-applying and conforming transport member.

The illustrated system is a post-fuser system, for fusing an image which has been transferred, but not fully fixed, to a recording member. It may also be embodied in a system, shown in FIG. 5, wherein a single belt serves as a latent image forming member and also subsequently receives, transfers and fuses the toned image. Thus, together with a toner reservoir and other components of an electrographic printer, the imaging and fusing operations are highly integrated. Suitable image producing elements are specifically shown as a corona rod **21*a* for erasing residual charge from the belt, and an electrographic print cartridge 21*b* for "writing" a pointwise latent charge image on the belt, and a toner reservoir/applicator 4** for toning the latent charge image on the belt. Suitable print cartridges for this purpose are those of the type described in U.S. Pat. Nos. 4,155,093, 4,160,257 and others. Preferred systems utilize print cartridges which project ions or electrons at the belt by means of various steering or accelerating electrodes, Possibly using a flow of a carrier gas.

In alternative embodiments, the belt may have a multilayer photoconductive construction. In that case, the latent charge image is achieved by rotating the belt past a corona rod biased to establish a uniform surface potential on the belt, applying an appropriate potential to a subsurface conductive layer, and then directing a modulated light beam or a focused image onto the belt to selectively charge or discharge the belt in accordance with the light intensity. In either case, the cleaner roller 29 assures that residual toner is not carried into the optical or electronic sub-assembly of the printer that forms the latent image.

Figure 5:
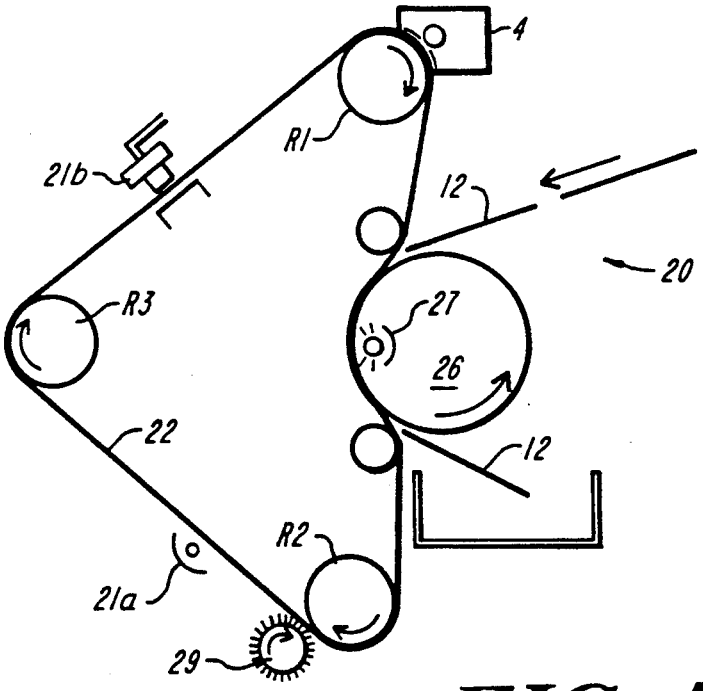
FIG. 5 shows a printer in which the imaging belt serves as a fusing belt.

In the embodiment of FIGS. 2 or 5, the sheet 12 receives an image on its top surface, and then exits from the printing path in a fully fixed state turned upside down, with the fixed image on its lower surface. The assembly thus prints and flips a sheet, as the sheet follows a transport path over the heater, thus constituting a printer configuration which may be easily inserted into or extended to a duplex or multi-color printer processing line or assembly. Since the heater is maintained at a relatively low temperature, for example between 105° and 120° C., which is close to the toner melt temperature, the belt may contain heat-sensitive fillers, such as photoconductive material, and may also efficiently be cooled to a lower temperature for passage through the toning section 4.

One aspect of the belt construction which is important to the operation of the printing apparatus relates to the toner pick-up and release characteristics of the belt 22. These attributes will be discussed with reference to the electrographic printhead structure mentioned above, which, in accordance with general principles known in the art, operates by depositing a latent image charge formed by projection of charge carriers onto a dielectric member such that a charge of up to several hundred volts is deposited at a point of the member for attracting toner particles to the dielectric member and develop a visible image.

For such operation, applicant has employed a belt with a capacitance of approximately 125 to 225 pf/cm$^2$, and considers a preferred range for other common charging and toning systems to be generally in the range of 50 to 500 pf/cm$^2$. For certain systems, such as one with a stylus-type charging head, a higher belt capacitance of approximately 1000 pf/cm$^2$ may be desired, while for other systems operation with a belt capacitance as low as 10 pf/cm$^2$ may be feasible. The construction of a preferred belt having a capacitance of 125–225 pf/cm$^2$ falling within such capacitance range is discussed in greater detail below, following consideration of toner release characteristics.

The applicant assignee of the present invention has found that the provision of a belt toner transfer member which conforms adequately to a paper surface for full transfer of a toned image Presents a technical problem. The outer skin of the belt is preferably of a hard material, in order to assure that powdered toner is not entrained in the surface but is attracted to and maintained at only those regions bearing a latent image charge. Applicant has further found that microscopic voids can appear in the transferred image and that these voids correspond to irregular surface features in the paper or other print medium. Thus, paper fibers, grit and surface features having a dimension of approximately 0.01 mm, characteristic of the surface roughness of a paper surface, may prevent the full transfer of toner when the sheet is passed against the toner-bearing belt.

These two problems can be overcome by providing on the belt 22 an elastomeric layer of a sufficient softness to conform to a rough paper surface, and by covering the elastomeric layer with a hard but thin surface coating. The hard coating is sufficiently thin to still allow the belt surface to conform to the rough paper surface, but is hard enough to assure that the belt surface does not conform to smaller features, such as dust or toner particles, over any substantial portion of their surfaces, and so does not entrain such paper dust or toner particles. The hard coating is sufficiently hard to prevent surface conformance to features of 100 Angstroms or less, and this prevents surface attractive effects, such as the van der Waals molecular attractive forces, from acting on a toner particle over an area of intimate contact so large as to cause it to adhere it to the belt.

On the other hand, when the toner is heat-softened or melted, and mechanical pressure is applied to transfer the toner to a paper or other material, applicant has found that a surface formed of a low surface free energy material advantageously prevents toner in its liquid state from remaining or sticking to the belt surface. These several characteristics of the belt assure that the surface is not "tacky" and does not develop sufficient molecular attractive forces to retain toner in the absence of the applied latent image charge, or in the presence of the mechanical adhesion or "wicking" of the heated toner to paper.

By way of example, suitable elastomeric and hard coating properties may be obtained with an elastomeric layer approximately 0.05 mm thick formed on a KAPTON belt with a silicone rubber of a 30 shore A durometer, overcoated with a 0.005 mm thick layer of a polymer having a hardness of approximately 35–45 Shore D.

A suitable hard coating material is the silicone resin conformal coating material sold by Dow Corning as its R-4-3117 conformal coating. This is a methoxy-functional silicone resin in which a high degree of cross-linking during curing adds methoxy groups to elevate the overall molecular weight of the polymerized coating. Suitable materials for the belt substrate include 0.05 mm thick films of Ultem, Kapton, or other relatively strong and inextensible web materials such as silicone-filled woven NOMEX or KEVLAR cloth, capable or operating at temperatures of up to approximately 200° C. For a direct belt-imaging construction as in FIG. 5, suitable conductive material is included in or on the substrate layer to control charging and provide a ground plane. Suitable elastomeric intermediate layer materials include silicone rubbers, fluoropolymers such as VITON, and other moderately heat-resistant materials having a hardness preferably in the range of about 20–50 Shore A.

Figure 3A:
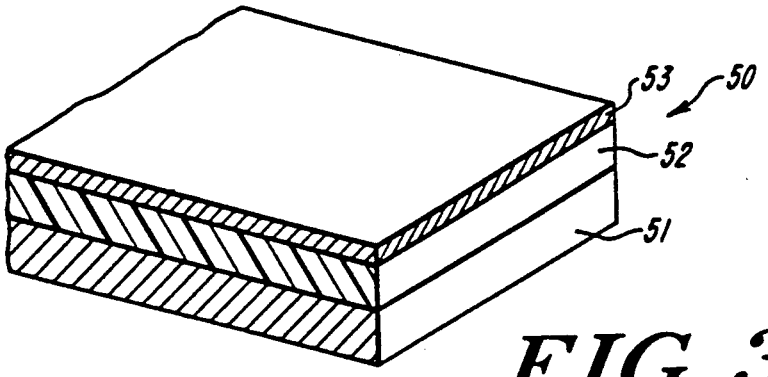
FIGS. 3A–3C show the structure of dielectric imaging belts utilized in the invention.
Figure 3B:
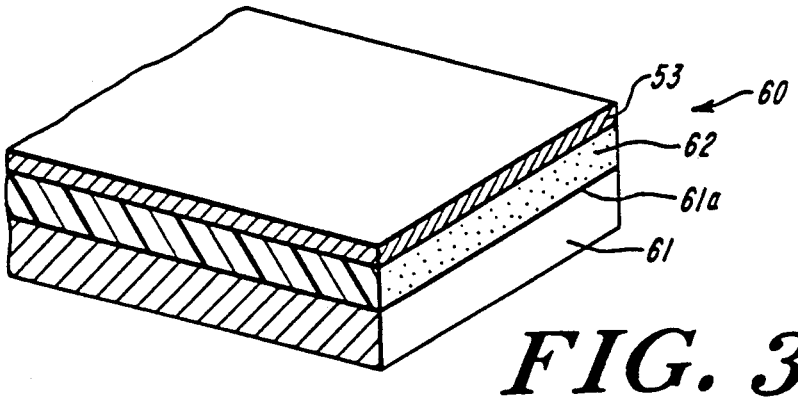
Figure 3C:
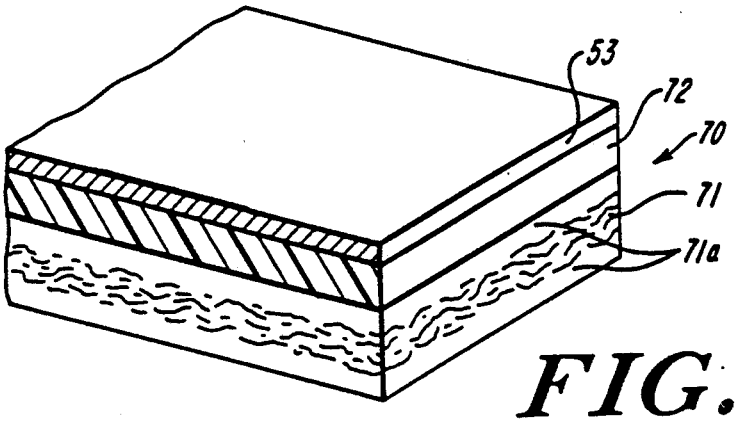

FIGS. 3A, 3B, 3C show three different belt constructions 50, 60 and 70 illustrating a range of desirable features.

In FIG. 3A, a belt 50 includes an electrically conductive support 51 of 0.05 mm thick aluminized KAPTON, having a 0.04 mm thick layer 52 of a silicone rubber overcoated with a hard skin coat 53 which is 0.005 mm thick. Layer 52 has a hardness of 35 Shore A durometer, whereas surface coat 53 has a 45 Shore D durometer. Because the various polymers have relatively low dielectric constants of between two and three, the multilayer construction is preferably modified to carry a latent image by including a high dielectric filler material in at least one layer. The use of filler in this manner also increases the hardness, and accordingly a thicker elastomer layer or a softer elastomer is used in such a construction to retain the desired surface conformability.

FIG. 3B shows one such filled belt construction, 60. In this embodiment, the substrate is formed of 0.05 mm thick thermally conductive film 61 having a metallized face 61*a*, such as the MT film manufactured by Dupont. A suitable elastomeric layer 62 may be formed of a 0.05 mm coating of silicone rubber compounded by Castall, Inc. of Weymouth, Mass. loaded with a sufficient amount of barium titanate in a prepared formulation to achieve a dielectric constant of 13, and having a net hardness of about 40–45 Shore A.

The hard skin outer coat 53 is identical to that described above of FIG. 3A. Other additives may be mixed in or substituted in order to adjust the belt capacitance, thermal conductivity or belt hardness. For example, a metal powder filler achieves high capacitance without excessive hardening.

FIG. 3C shows an alternative belt construction 70 wherein a low density woven fabric belt 71 is impregnated with a soft electrically conductive silicone rubber binder 71*a* to form a conductive layer 0.075 mm thick. A suitable rubber may have a hardness of 35 Shore A durometer, and electrical conductivity of $10^3$ ohm centimeters. In this case, the substrate itself is conformable, and the silicone rubber layer 72 which may be a conductive material like that of layer 71*a*, may thus be made quite thin since no additional softness is needed. For example, layer 72 may be formed with an elastomer of 30 Shore A hardness and a thickness of under 0.05 mm. Layer 72 is coated with a hard skin 53 as in the other examples. The layer 53 is sufficiently thin to achieve a high capacitance without a filler. When the belt is used only for fusing layer 53 may also be conductive.

In the last two above cases, the use of a conductive substrate allows the belt to be grounded by using grounded conductive rollers R1, R2, R3 and a grounded platen opposite the printhead in the apparatus of FIG. 5.

A photoconductive filler material may also be substituted to allow formation of the latent image by optical imaging techniques, rather than direct charge deposition techniques.

When using the Dow corning R-4-3117 silicone resin coating material described above as the non-tacky surface coat, applicant has found that outer layers having a thickness of 0.0025–0.005 mm appear thin enough to allow the belt to conform to surface roughness features of 0.01 mm while being sufficiently hard to prevent toner entrainment. Surface layers thicker than 0.0075–0.01 mm appear too stiff to permit complete image transfer to a paper surface in the embodiment of FIG. 5, and may be too stiff to provide fully effective contact for fusing in the embodiment of FIG. 2. In general, however, a less conformable surface is required for construction in which the belt is only used for fusing. The required degree of elasticity also depends on the nip pressure. In fabricating the hard surface coat, applicant employed a Mayer wire-wound rod as the applicator. For forming the intermediate elastomer layer, the silicone rubber material was coated onto an inextensible belt by a knife and roller assembly to create a smooth coating of uniform thickness.

Various modifications of the surface coating constructions indicated above are possible to achieve the desired surface properties. For example, to achieve a hard coat over the soft silicone rubber, one may treat the silicone rubber surface by nitrogen ion bombardment at ion energies of 50–100 KeV and a current of about 0.01 microamps/$cm^2$, with a dose of $10^{13}$ ions/$cm^2$. This provides a slippery hard surface which does not entrain toner powder. Another technique is to treat the elastomer coating by exposure to a plasma. Both ion-bombardment and Plasma-reaction techniques are believed to promote cross linking of the surface material. Particular materials may be employed to achieve a desired degree of cross-linked polymerization. For example, a surface coat of a vinyl-dimethyl silicone rubber may be polymerized by electron beam radiation to provide the hard skin of appropriate thickness and hardness. The polymerization of the skin may also be effected by ultraviolet, catalytic, corona or chemical polymerization techniques.

In any of these fabrication techniques for a conforming surface release fusing belt or a combination imaging-/fusing belt, the substrate Provides dimensional stability, while the substrate and subsurface layers together are selected to have sufficient softness to conform to a print member, such as metal sheet, paper or acetate, having a characteristic surface roughness, when urged by a pressure roller at a relatively low pressure of fifty to one hundred and fifty PSI in the case of an imaging belt, and as low as several PSI in the case of a fusing belt.

The elastic deformation of the belt coating must be commensurate with the intended surface roughness at this pressure. The elastic deformation further provides excellent thermal transfer characteristics for heating the printed sheet at the image fusion stage. On top of the elastomeric layer, the hard surface coat is then formed to be sufficiently hard and thick to prevent entrainment of toner, while not being so hard or thick as to interfere with dimensional conformance of the surface. By using a surface coat of low surface free energy, softened or melted toner does not adhere to the belt. The toner transfers fully and completely to the print member when pressed. A surface free energy of 20 dynes/cm or less is desirable.

The aforesaid belt properties allow image transfer at pressures which are sufficiently low that they do not disturb the image, or even disturb previously laid down images, and are especially adapted for successively printing different color components of a multi-color image, or a two-sided image.

Figure 4:
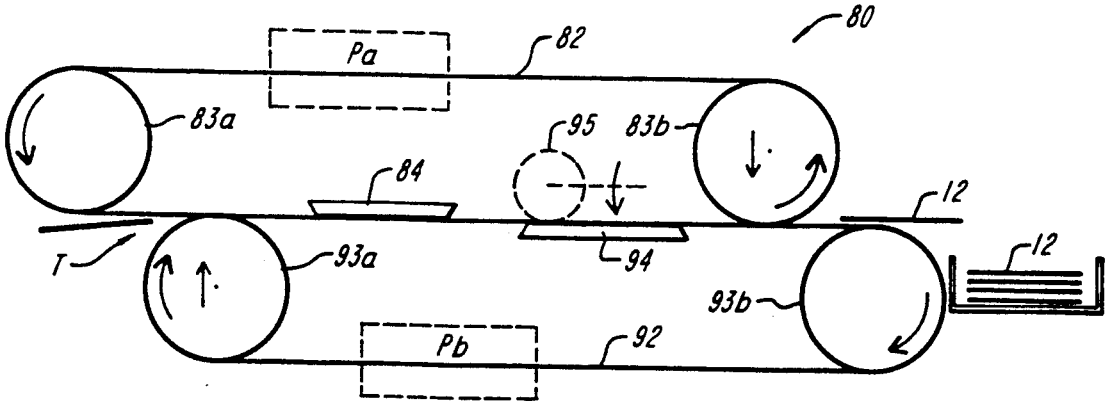
FIG. 4 shows an embodiment of the invention for two sided fusing.

FIG. 4 shows another fuser embodiment 80, especially adapted to a two sided printer in accordance with the present invention. The system 80 includes first and second moving belts 82, 92, which face each other along a transport path T. Each belt rotates over corresponding rollers 83*a*, 83*b* or 93*a*, 93*b*, and has a heated region defined by a corresponding hot platen 84 or 94 in the region at which the belts face each other. The platens extend for substantial length between the rollers, for example fifteen centimeters or more, allowing effective heat transfer to and through the belts to a recording sheet 12 even at a high linear belt speed. Further, the two platens are closely spaced, so that a sheet fed along transport path T contacts both belts as it passes on the transport path. The area of the heaters corresponds to between one-third and several times the area of the recording sheet, so that the sheet approaches thermal equilibrium with the heater during its relatively long dwell in thermal contact therewith.

As illustrated, the rolls are arranged so that one roll 83*b*, 93*a* of each pair is biased past the plane of the opposed platen 94, 84, respectively, so that as a sheet 12 is carried between the two belts along the transport path T the sheet is urged against each platen. An additional roller, of which one is illustrated in phantom at 95, may be provided, or the existing rollers relocated, opposite each Platen to provide a pressure nip for assuring adequate contact with the toned sheet. Such nip may be especially desirable in embodiments, discussed further below, in which a toner image is transferred from the belt to the recording sheet.

In this double belt embodiment, the belts 82, 92 or at least one of them may have a considerably thicker elastomeric body, so that the sheet 12 lies in a state of compression with both surfaces bearing against the belts as it is heated.

In FIG. 4, the dashed boxes $P_a$ and $P_b$ schematically represent the portions of the belts 82, 92 outside the image fusing region. These portions may pass over one or more additional rollers for positioning or tensioning the belt, and also may each include one or more subassemblies such as cleaners, erase rods, print cartridges or other latent imaging modules, and toner applicators, to effect electrostatic latent imaging and toner developing operations on the moving belt, in the appropriate order as described above for the belt-and-drum embodiment. The structure and operation of an imaging system of this type is described in the commonly-assigned patent application of William R. Buchan et al entitled Powder Transport, Fusing and Imaging Apparatus, Ser. No. 355,994 filed May 23, 1989. The text and drawings of that patent application are hereby incorporated by reference.

In different embodiments, multicolor printing on a single belt is possible with additional print cartridges or toner applicators, and printing may be performed in a multi-pass manner by passing the sheet alternatively in forward and in reverse directions through the fusing region after multiple successive toning and imaging operations. Also, multiple different toners may be applied having fusing temperatures that vary by discrete amounts. In such embodiments, a first fuser operated at a highest temperature may fuse one toner, after which a second toner is laid down and fused by a second fuser operating at a lower temperature.

In this regard, the low-pressure, extended dwell time fusing operation of this embodiment is an adaptable processing module, which may be run in forward or reverse directions, with fully or partially toned sheets, on one or two sides. The Process operates at lower temperatures than a hot pressure nip roller, and provides excellent results with a monocomponent toner. In addition, the long dwell time belt fuser of the present invention is adapted to a broad range of printing stocks from thinner than a paper sheet to thicker than card or even corrugated stock, since a biased roller and belt can readily accommodate different thickness dimensions, and a longer dwell time over the heater platen can bring thicker recording members to a fusing temperature. Typical dwell times are between one quarter and several seconds, preferably between about one half and one second.

When used as a separate fusing assembly, a belt of high thermal capacity may be used without excessive energy losses. When a single belt is used for both imaging and fusing, the belt is preferably of low thermal capacity, and is cycled between a low temperature at the toning station to a fusing temperature at the fusing station.

Apparatus and methods of printing in accordance with the present invention are adapted to a wide range of print systems, of which the foregoing embodiments are taken to be illustrative, without being limited thereto. By way of comparison to other popular fusing technologies, the present invention can operate with mono- or dual-component toners, of conductive or non-conductive type. The belt thermal contact transfers heat effectively to toner of any color, unlike radiant fusers. Furthermore, the highest temperature required may be just slightly above the toner melt temperature, typically 100°-120° C., and the belt may be of arbitrary length to include an intermediate cooling portion or a remote toning or charging stations, so that a single belt may be operated at a sufficiently low temperature to also effect the imaging and toning operations without resort to intermediate image transfer members.

It will be understood that while FIGS. 2 and 4 illustrate embodiments in which a belt performs fusing functions, other embodiments of the invention may integrate the electrostatic image forming and toning functions, or the toning and image transfer functions, with fusing carried out in a section through which the same belt operates as a heat transfer or pressure applying member, having received its electrostatic or toned image at an earlier stage. In any case, low temperature heat is applied to or through the toner-carrying belt to fuse the toned image to a sheet as the belt moves synchronously therewith and in contact with the toned image over the heater.

The basic embodiments and operative aspects of the invention being thus described, modifications and variations will occur to those skilled in the art, and such modifications and variations are considered to be within the spirit and scope of the invention defined by the claims appended hereto.

What is claimed is:

1. A heat fusing apparatus comprising a belt having a non-tacky surface which is abherent with respect to a melted toner, said belt extending the width of a recording sheet heating means for providing heat to a region of the belt having an area between approximately one third and several times as large as a printable area of the recording sheet, the heat heating the belt to a temperature not substantially above a melt temperature of a toner forming a toned image on the recording sheet, and means for thermally contacting a toned side of the recording sheet to the abherent surface of the belt and synchronously moving the belt and the recording sheet such that an extend region of each is in contact as they move past the heating means so that the recording sheet attains the melt temperature of the toner whereby the toned image is efficiently and cleanly fused to the recording sheet as a permanent print.

2. A heat fusing apparatus according to claim 1, wherein the heating means includes a heat platen over which the belt travels in thermal contact.

3. A heat fusing apparatus according to claim 2, wherein the means for contacting includes a second belt which rotates synchronously with the belt to transport the recording sheet therebetween over the heated platen.

4. A heat fusing apparatus according to claim 1, wherein the belt has an abherent surface layer and an elastomeric sublayer.

5. A heat fusing apparatus according to claim 4, wherein the belt includes an electrically conductive sublayer below a layer of dielectric or photoconductive material, and further comprising means for forming a latent charge image on the belt means for toning the latent charge image to produce a toned image, and means for transferring the toned image to the recording sheet for fusing.

6. A heat fusing apparatus according to claim 5, wherein the belt is a thin belt that Provides thermal contact through the belt between the heating means and the toned image on the recording sheet.

7. A heat fusing apparatus according to claim 1, wherein the heating means includes a heated drum which contacts the belt over a substantial portion of its circumference.

8. A heat fusing apparatus according to claim 7, wherein the belt transports and flips the recording sheet as the toned image is fused.

9. A heat fusing apparatus according to claim 7, wherein the belt includes an electrically conductive subsurface layer and a layer of dielectric or photoconductive material, and further comprising means for forming a latent charge image on the belt means for toning the latent charge image to produce a toned image, and means for transferring the toned image to the recording sheet for fusing.

10. Printing apparatus, comprising charge writing means for forming a latent charge image developing means for toning the latent charge image to form a toned image means for applying the toned image to a recording sheet a belt assembly including a belt having a release surface which is abherent to melted toner and at least one pair of spaced apart rollers about which the belt is driven in a circuit for carrying the recording sheet heating means maintained at temperature not substantially over a toner fusing temperature and positioned for heating the belt to said toner fusing temperature in a heated portion of the circuit extending over an area comparable to the area of the recording sheet, and press means for urging the recording sheet into contact with the belt while the sheet moves synchronously with the belt through the heated portion of the circuit so that the image is brought to the toner fusing temperature by thermally contacting the belt release surface and is fused to the sheet.

11. Printing apparatus according to claim 10, wherein the press means includes an endless belt positioned opposite to the heated portion of the belt such that the sheet is transported between and in contact with both the endless belt and the belt of the belt assembly over a rigid heater body as the toned image is fused.

12. Printing apparatus according to claim 10, wherein the press means includes a drum which bears against the belt and moves synchronously therewith along a fusing region comprising an arc of over approximately $\pi/2$ along the drum surface, said drum being located to press the sheet into thermal contact with the belt along said arc.

13. Printing apparatus according to claim 11, wherein belt is a dielectric belt and the sheet receives the toned image as it travels in contact with the belt intermediate the rollers.

14. Printing apparatus according to claim 13, wherein the endless belt carries a second toned image, and the sheet receives an image from each of the endless belt, and the belt of the belt assembly, on opposite sides of the sheet to form a two-sided print which is fused as it passes the heated portion of the circuit.

15. Printing apparatus according to claim 10, wherein said press means urges a substantial portion of the sheet into thermal contact with the belt as the sheet is carried along the belt to efficiently transfer heat to the sheet at a low temperature over an extended transport path.

16. Printing apparatus according to claim 10, wherein the belt has a subsurface layer of conformable material having a hardness under approximately 35 Shore A durometer.

17. Printing apparatus according to claim 10, wherein the press means includes a heated drum positioned such that the belt is placed under tension against an arcuate surface of the drum and moves at a surface speed of the drum with the recording sheet immobilized therebetween while the toned image is brought into thermal equilibrium with the drum.

18. Printing apparatus according to claim 10, wherein the press means comprises a pair of facing co-rotating belts which run over at least one heated platen located in a fusing region that extends for a distance such that the sheet attains thermal equilibrium with the heated platen as the sheet is transported between the belts.

19. A heat fusing apparatus comprising a belt extending the width of a recording sheet and having a surface release property with respect to melted toner heating means for providing heat to region of the belt extending entirely across an intended print area, the heat being controlled to a temperature not substantially above a melt temperature of the toner, and means for moving the belt to transport a recording sheet such that the belt and recording sheet move synchronously in contact with each other on an extended region of the sheet past the heater means for a dwell time effective for the sheet to substantially attain thermal equilibrium with the belt at the melt temperature of the toner, the belt pressing the sheet and thereby fusing a toner image to the recording sheet.

20. A heat fusing apparatus according to claim 19, wherein the belt is a transfer belt which receives an image from an imaging member and transfers the image to the recording sheet.

* * * * *